US007090624B1

(12) United States Patent
Chrishon

(10) Patent No.: US 7,090,624 B1
(45) Date of Patent: Aug. 15, 2006

(54) EXERCISE SYSTEM

(76) Inventor: Marcellus D. Chrishon, 28 Veneto La., Aliso Viejo, CA (US) 92656

( * ) Notice: Subject to any disclaimer, the term of this patent is extended or adjusted under 35 U.S.C. 154(b) by 540 days.

(21) Appl. No.: 09/991,041

(22) Filed: Nov. 21, 2001

(51) Int. Cl.
*A63B 21/065* (2006.01)

(52) U.S. Cl. ..... 482/105

(58) Field of Classification Search ..... 482/74, 482/79, 105; D21/683
See application file for complete search history.

(56) References Cited

U.S. PATENT DOCUMENTS

| | | | | |
|---|---|---|---|---|
| 2,241,833 | A * | 5/1941 | Waller | 482/105 |
| 3,278,184 | A * | 10/1966 | Rosenbaum | 482/105 |
| 3,306,610 | A * | 2/1967 | Biggs, Jr. et al. | 482/105 |
| 3,759,510 | A * | 9/1973 | Jackson, Jr. | 482/105 |
| 4,180,261 | A * | 12/1979 | Kolka | 482/105 |
| 4,303,239 | A | 12/1981 | Walsh, Jr. | |
| 4,383,546 | A * | 5/1983 | Walters, Jr. | 137/240 |
| 4,384,369 | A * | 5/1983 | Prince | 2/79 |
| D278,455 | S * | 4/1985 | Nosek | D21/683 |
| 4,958,386 | A | 9/1990 | Louis-Jeune | |
| 4,974,398 | A | 12/1990 | Kaski | |
| 5,144,694 | A * | 9/1992 | Conrad Da oud et al. | 482/105 |
| D352,369 | S | 11/1994 | Figoni | |
| 5,514,056 | A | 5/1996 | Ronca et al. | |
| 5,553,322 | A * | 9/1996 | Cebo-Johnson | 2/69 |
| D390,338 | S * | 2/1998 | Plasco | D21/683 |
| 5,937,441 | A * | 8/1999 | Raines | 2/69 |
| 5,951,446 | A | 9/1999 | Monforte | |
| 6,039,677 | A * | 3/2000 | Spletzer | 482/105 |
| 6,554,752 | B1 * | 4/2003 | Cook | 482/105 |
| 6,557,176 | B1 * | 5/2003 | Franco-Sion | 482/105 |
| 2002/0010058 | A1 * | 1/2002 | Myrick | 482/92 |
| 2006/0046913 | A1 * | 3/2006 | Squittieri | 482/124 |

FOREIGN PATENT DOCUMENTS

| | | |
|---|---|---|
| WO | WO 02/26330 A1 * | 4/2002 |

* cited by examiner

*Primary Examiner*—Gregory L. Huson
*Assistant Examiner*—Victor K. Hwang

(57) ABSTRACT

An exercise system for allowing a user to increase endurance, power, speed, quickness, and overall body conditioning. The exercise system includes a body member that is adapted to snuggly fit around a portion of a user. A plurality of pockets is coupled to the body member. Each of the pockets has a flap that is secured to a front panel of each the pockets such that the flap is for closing each of the respective pockets. A plurality of weight members each are selectively insertable into each of the pockets such that the weight members are adapted to change the weight resistance against the muscles of the user when the body member is fitted around a portion of a user.

19 Claims, 5 Drawing Sheets

EXERCISE SYSTEM

BACKGROUND OF THE INVENTION

1. Field of the Invention

The present invention relates to exercise systems and more particularly pertains to a new exercise system for allowing a user to increase endurance, power, speed, quickness, and overall body conditioning.

2. Description of the Prior Art

The use of exercise systems is known in the prior art. More specifically, exercise systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,951,446; U.S. Pat. No. 4,303,239; U.S. Pat. No. 4,958,386; U.S. Pat. No. 4,974,398; U.S. Pat. No. Des. 352,369; and U.S. Pat. No. 5,514,056.

While these devices fulfill their respective, particular objectives and requirements, the aforementioned patents do not disclose a new exercise system. The inventive device includes a body member that is adapted to snuggly fit around a portion of a user. A plurality of pockets is coupled to the body member. Each of the pockets has a flap that is secured to a front panel of each the pockets such that the flap is for closing each of the respective pockets. A plurality of weight members each are selectively insertable into each of the pockets such that the weight members are adapted to change the weight resistance against the muscles of the user when the body member is fitted around a portion of a user.

In these respects, the exercise system according to the present invention substantially departs from the conventional concepts and designs of the prior art, and in so doing provides an apparatus primarily developed for the purpose of allowing a user to increase endurance, power, speed, quickness, and overall body conditioning.

SUMMARY OF THE INVENTION

In view of the foregoing disadvantages inherent in the known types of exercise systems now present in the prior art, the present invention provides a new exercise system construction wherein the same can be utilized for allowing a user to increase endurance, power, speed, quickness, and overall body conditioning.

The general purpose of the present invention, which will be described subsequently in greater detail, is to provide a new exercise system apparatus and method which has many of the advantages of the exercise systems mentioned heretofore and many novel features that result in a new exercise system which is not anticipated, rendered obvious, suggested, or even implied by any of the prior art exercise systems, either alone or in any combination thereof.

To attain this, the present invention generally comprises includes a body member that is adapted to snuggly fit around a portion of a user. A plurality of pockets is coupled to the body member. Each of the pockets has a flap that is secured to a front panel of each the pockets such that the flap is for closing each of the respective pockets. A plurality of weight members each are selectively insertable into each of the pockets such that the weight members are adapted to change the weight resistance against the muscles of the user when the body member is fitted around a portion of a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new exercise system apparatus and method which has many of the advantages of the exercise systems mentioned heretofore and many novel features that result in a new exercise system which is not anticipated, rendered obvious, suggested, or even implied by any of the prior art exercise systems, either alone or in any combination thereof.

It is another object of the present invention to provide a new exercise system, which may be easily and efficiently manufactured and marketed.

It is a further object of the present invention to provide a new exercise system, which is of a durable and reliable construction.

An even further object of the present invention is to provide a new exercise system which is susceptible of a low cost of manufacture with regard to both materials and labor, and which accordingly is then susceptible of low prices of sale to the consuming public, thereby making such exercise system economically available to the buying public.

Still yet another object of the present invention is to provide a new exercise system which provides in the apparatuses and methods of the prior art some of the advantages thereof, while simultaneously overcoming some of the disadvantages normally associated therewith.

Still another object of the present invention is to provide a new exercise system for allowing a user to increase endurance, power, speed, quickness, and overall body conditioning.

Yet another object of the present invention is to provide a new exercise system which includes a body member that is adapted to snuggly fit around a portion of a user. A plurality of pockets is coupled to the body member. Each of the pockets has a flap that is secured to a front panel of each the pockets such that the flap is for closing each of the respective pockets. A plurality of weight members each are selectively insertable into each of the pockets such that the weight members are adapted to change the weight resistance against the muscles of the user when the body member is fitted around a portion of a user.

Still yet another object of the present invention is to provide a new exercise system that would allow a user to strengthen their muscles, increase endurance and flexibility while performing everyday tasks such as cutting the grass.

Even still another object of the present invention is to provide a new exercise system that could be offered in various sizes to fit all users, and it would be equally effective on a male or female.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
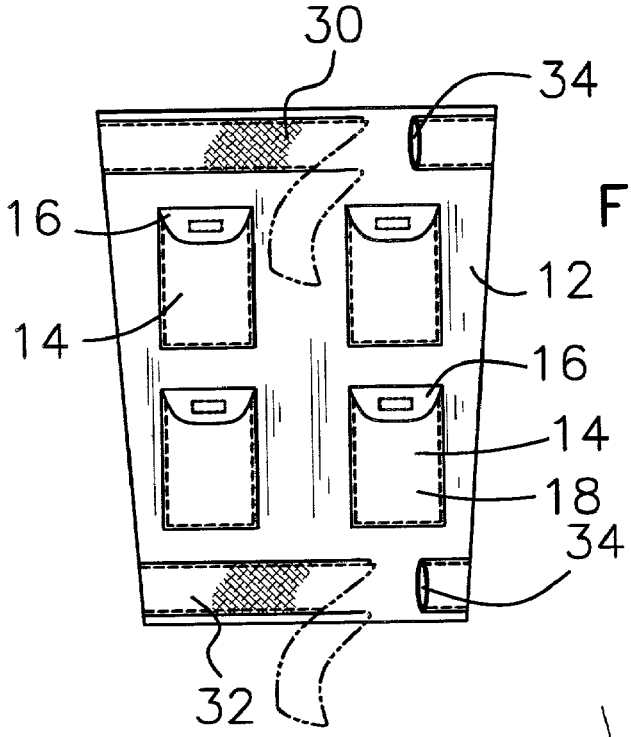
FIG. 1 is a front view of a new exercise system according to the present invention.
Figure 2:
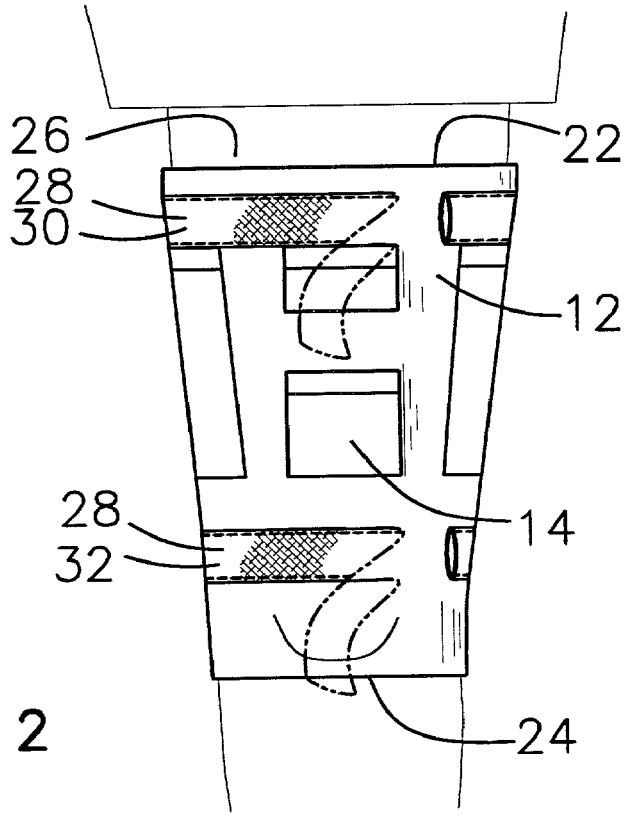
FIG. 2 is a side view of the present invention.
Figure 3:
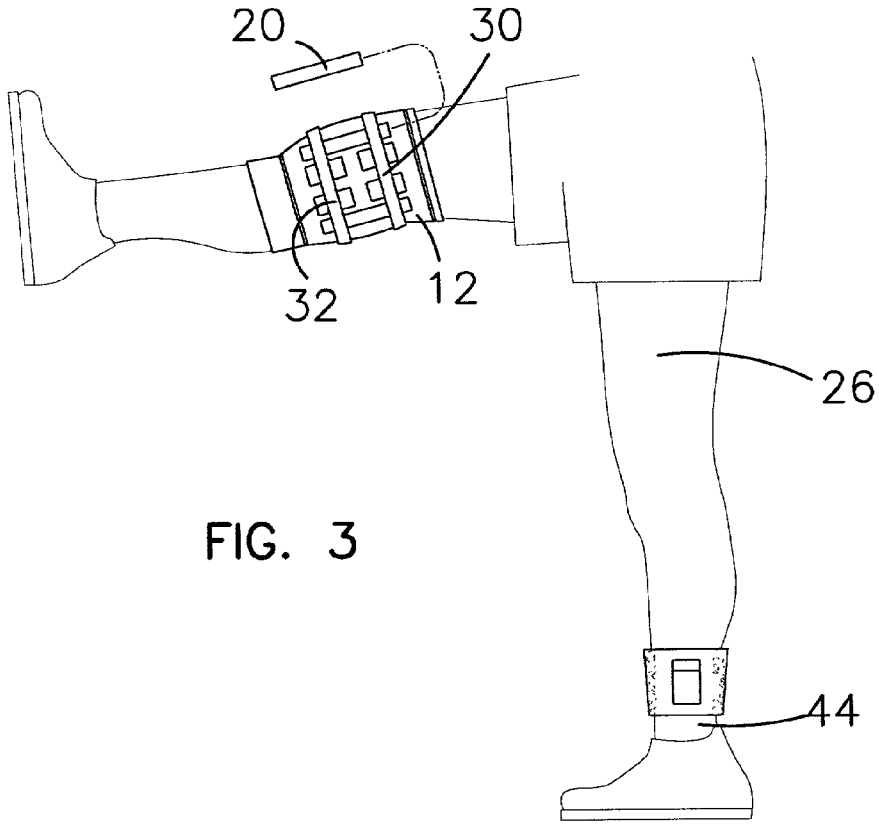
FIG. 3 is a side view of the present invention.
Figure 4:
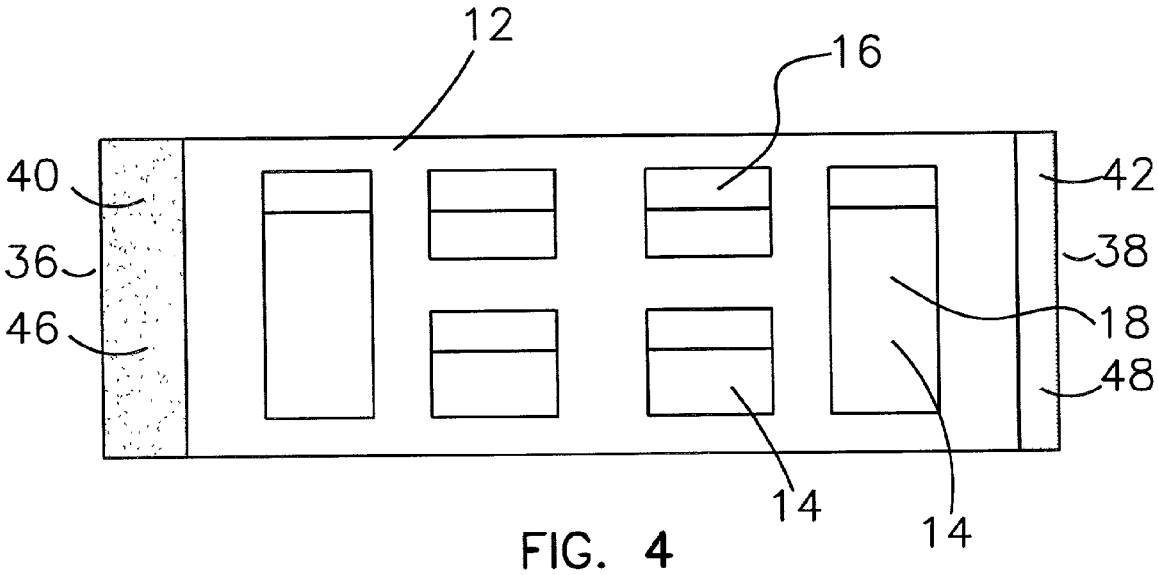
FIG. 4 is a front view of the present invention.
Figure 5:
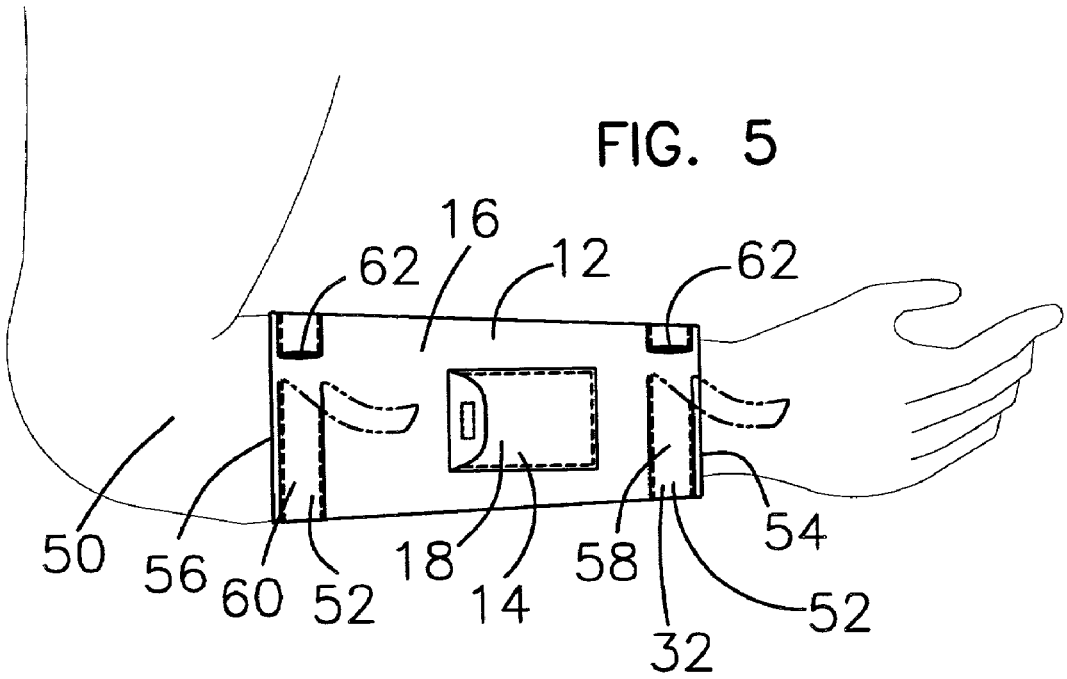
FIG. 5 is a front view of the present invention.
Figure 6:
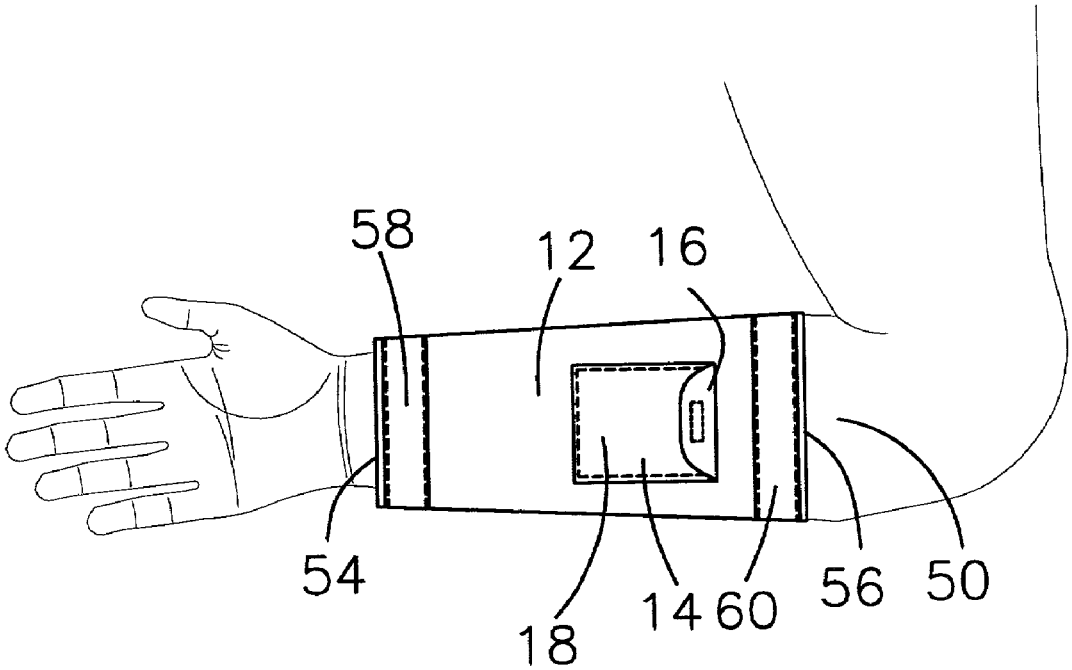
FIG. 6 is a back view of the present invention.
Figure 7:
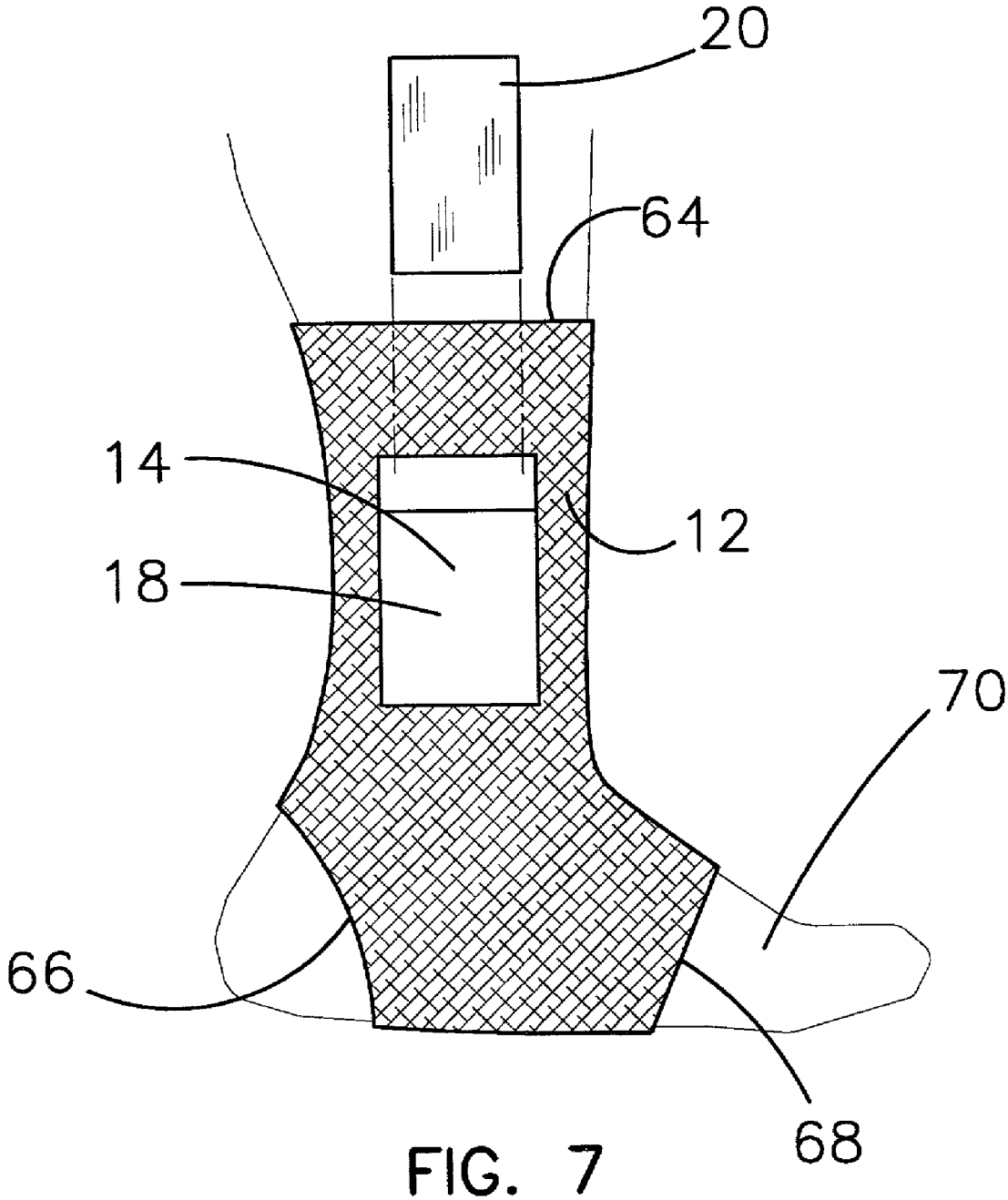
FIG. 7 is a side view of the present invention.
Figure 8:
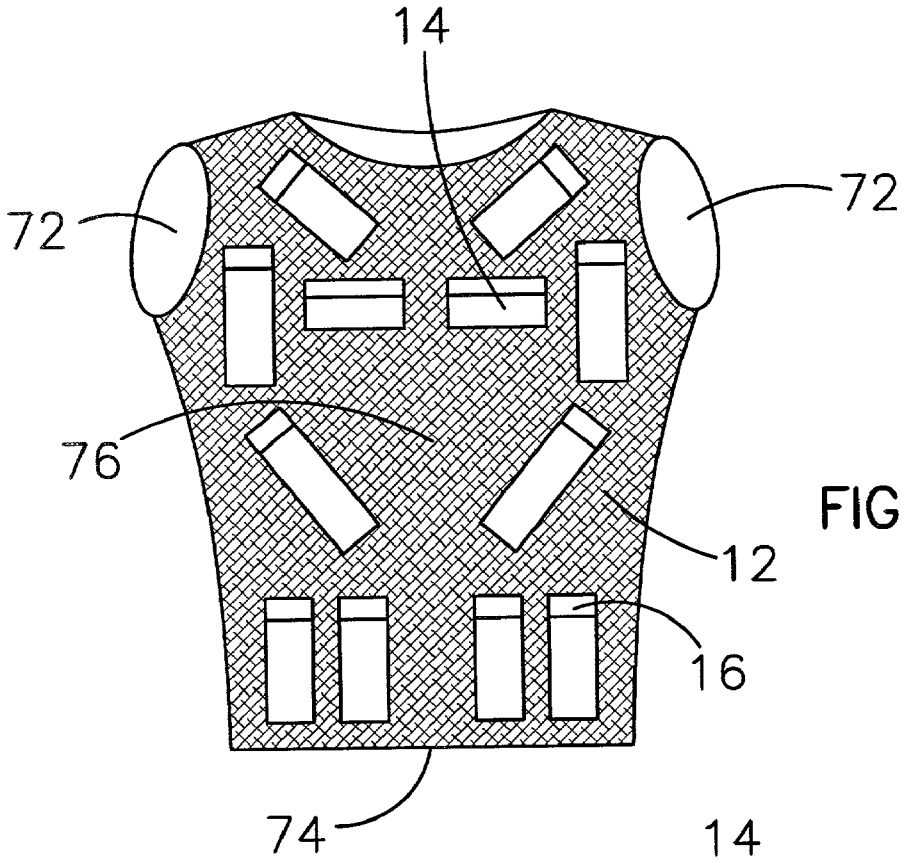
FIG. 8 is a front view of the present invention.
Figure 9:
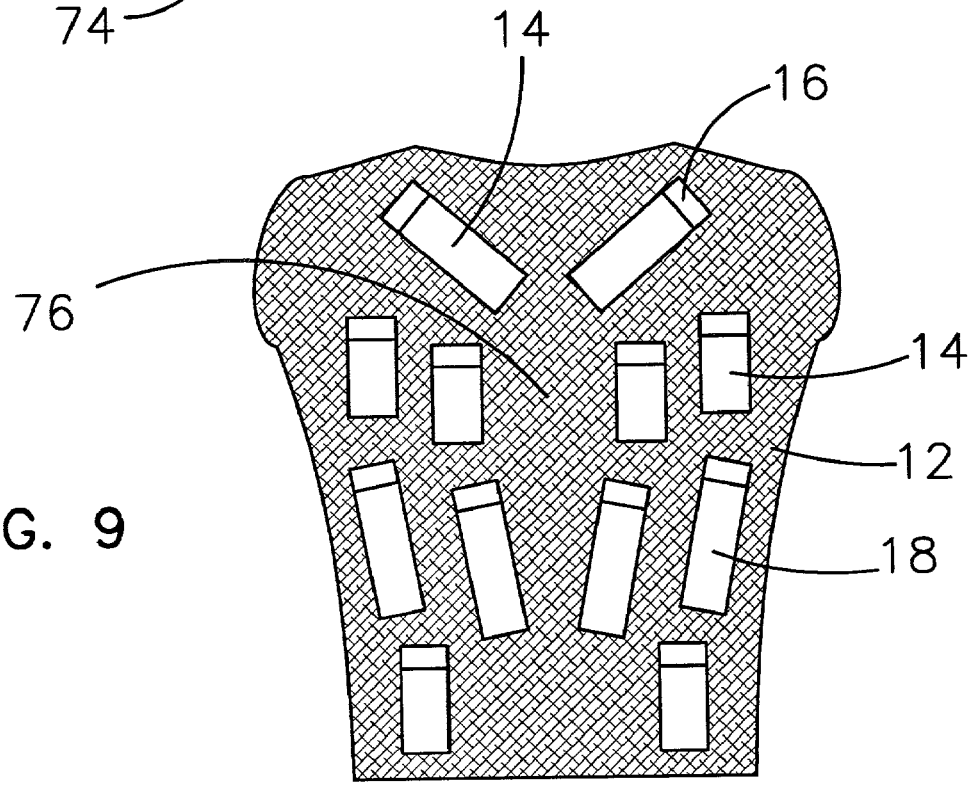
FIG. 9 is a back view of the present invention.

With reference now to the drawings, and in particular to FIGS. 1 through 9 thereof, a new exercise system embodying the principles and concepts of the present invention and generally designated by the reference numeral 10 will be described.

As best illustrated in FIGS. 1 through 9, the exercise system 10 generally includes includes a body member 12 that is adapted to snuggly fit around a portion of a user. A plurality of pockets 14 is coupled to the body member 12. Each of the pockets 14 has a flap 16 that is secured to a front panel 18 of each the pockets 14 such that the flap 16 is for closing each of the respective pockets 14. A plurality of weight members 20 each are selectively insertable into each of the pockets 14 such that the weight members 20 are adapted to change the weight resistance against the muscles of the user when the body member 12 is fitted around a portion of a user. The body member 12 inwardly tapers from an upper edge 22 to a lower edge 24 such that the body member 12 is adapted to be fitted a thigh 26 of the user.

A pair of support straps 28 is coupled to the body member 12 such that each of the support straps 28 is releasably coupled to itself for adjustably securing the body member 12 to the thigh 26 of the user. A first 30 of the support straps is positioned proximate the upper edge 22 of the body member 12, a second 32 of the support straps is positioned proximate the lower edge 24 of the body member 12. Each of the support straps 28 has a buckle 34 coupled to an end of the support strap 28. Each of the support straps 28 is to be extended through the respective buckle 34 and cinched back and secured to itself for ensuring securment of the body member 12 to the thigh 26 of the user.

The weight members 20 comprise a flexible material such that the weight members 20 are adapted to be conformed to a surface area of the user for preventing the weight members 20 from rubbing against the user.

The body member 12 is substantially planar has first end 36 and a second end 38. The first end 36 has a first fastener portion 40 that is to be releasably secured to a second fastener 42 of the second end 38. The body member 12 is adapted to be secured around an ankle 44 of a user. The first fastener 40 includes a first portion of hook and loop fastener 46. The second fastener 42 includes a second portion of hook and loop fastener 48 such that the first portion of hook and loop fastener 46 is complimentary to the second portion of hook and loop fastener 48 to be releasably secured to the first end 36 and to the second end 38 of the body member 12. The body member 12 inwardly tapers from a trailing edge 54 to a leading edge 56 such that the body member 12 is adapted for fitting a forearm 50 of the user.

A pair of cinch straps 52 is coupled to the body member 12 such that each of the cinch straps 52 is releasably coupled to itself for adjustably securing the body member 12 to the forearm 50 of the user. A first of the cinch straps 58 is positioned proximate the trailing edge 54 of the body member 12. A second of the cinch straps 60 is positioned proximate the leading edge 56 of the body member 12. Each of the cinch straps 52 has a cinch buckle 62 coupled to an end of each of the cinch straps 52. Each of the cinch straps 52 is to be extended through the respective cinch buckle 62 and cinched back and secured to itself for ensuring securment of the body member 12 to the forearm 50 of the user.

The plurality of pockets 14 includes a pair of pockets 14 is coupled to the body member 12. A first of the pockets 14 is coupled proximate a leading edge 56 of the body member 12. A second of the pockets 14 is coupled to the body member 12 proximate the trailing edge 54 of the body member 12 such that the second of the pockets 14 is adapted to be positioned on an opposite side of the forearm 50 of the user. The first of the pockets 14 is adapted for spreading the weight from the weight members 20 evenly over the forearm 50 of the user.

The body member 12 has a leg opening 64, a heel opening 66 and a toe opening 68 such that the body member 12 is adapted for inserting a foot 70 of the user to position the body member 12 over an ankle 44 of the user. At least one of the pockets 14 is positioned above the ankle 44 of the user for preventing the pocket 14 from rubbing on the ankle 44 of the user. The body member 12 has a pair of arm openings 72, a head opening 66 and a torso opening 74 such that the body member 12 is adapted for receiving a torso of a user. The body member 12 includes a back panel 76 and a front panel 78, the back panel 76 is adapted for covering a back of the user, the front panel 78 is adapted for covering a front of the user.

The plurality of the pockets 14 are positioned on the back panel 76 of the body member 12 between the pair of arm openings 72. The weight members 20 in the pockets 14 is adapted to be positioned over shoulder blades of the user for exerting weight resistance to the shoulders of the user. The plurality of the pockets 14 are positioned on the back panel 76 of the body member 12 below the arm openings 72, the weight members 20 in the pockets 14 is adapted for providing weight resistance to a lower back of the user. The plurality of the pockets 14 are positioned on the front panel 78 of the body member 12 between the arm openings 72, the weight members 20 in the pockets 14 is adapted for providing weight resistance to pectoral muscles of the user. The plurality of the pockets 14 are positioned on the front panel 78 of the body member 12 below the arm openings 72, the weight members 20 in the pockets 14 is adapted for providing weight resistance to the muscles of an abdominal area of the user.

In use, a user would strap the present invention to various parts of their body including but not limited to the ankle, thigh, forearm, shoulder, and abdominal region. The user could then perform any activity or exercise he or she wishes to improve overall strength and flexibility.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercise system comprising:

a plurality of body members being adapted for snuggly fitting around a portion of a user;

a plurality of pockets being coupled to each of said body members, each of said pockets having a flap for securing to a front panel of each said pockets such that said flap is for closing each of said respective pockets;

a plurality of weight members each being selectively insertable into each of said pockets such that said weight members are adapted for changing the weight resistance against muscles of the user when said body member is fitted around a portion of a user;

a first one of said body members inwardly tapering from a trailing edge to a leading edge such that said first body member is adapted for fitting a forearm of the user; and said plurality of pockets comprises a first pair of pockets being coupled to the first one of said body members, a first one of said first pair of pockets being coupled proximate a leading edge of the first one of said body members, a second one of said first pair of pockets being coupled to the first one of said body members proximate said trailing edge of the first one of said body members such that said second one of said first pair of pockets is adapted for being positioned on an opposite side of the forearm of the user from said first one of said first pair of pockets, said pockets being adapted for spreading the weight from said weight members evenly over the forearm of the user;

a second one of said body members inwardly tapers from an upper edge to a lower edge such that said second body member is adapted for fitting a thigh of the user;

said plurality of pockets comprises a second pair of pockets being coupled to the second one of said body members, a first one of said second pair of pockets being coupled proximate to the upper edge of the second one of said body members, a second one of said second pair of pockets being coupled to the second one of said body members proximate to the lower edge of the second one of said body members;

said plurality of pockets comprises a third pair of pockets being coupled to the second one of said body members, a first one and a second one of said third pair of pockets each extending from a location proximate to the upper edge to a location proximate the lower edge of the second one of said body members, the first one of said third pair of pockets being located on an opposite side of said second pair of pockets from the second one of said third pair of pockets.

2. The exercise system as set forth in claim 1, further comprising:

a pair of support straps being coupled to an associated one of said body members fitting on the thigh of the user such that each of said support straps is releasably coupled to itself for adjustably securing the associated one of said body members to the thigh of the user, a first of said support straps being positioned proximate said upper edge of the associated one of said body members, a second of said support straps being positioned proximate said lower edge of the associated one of said body members.

3. The exercise system as set forth in claim 2, wherein each of said support straps has a buckle coupled to an end of said support strap, each of said support straps being for extending through said respective buckle and cinched back and secured to itself for ensuring securement of the associated one of said body members to the thigh of the user.

4. The exercise system as set forth in claim 1, wherein at least one of said body members is substantially planar having a first end and a second end, said first end having a first fastener portion for releasably securing to a second fastener of said second end, the associated one of said body members being adapted for securing around an ankle of a user.

5. The exercise system as set forth in claim 4, wherein said first fastener comprises a first portion of hook and loop fastener, said second fastener comprising a second portion of hook and loop fastener such that said first portion of hook and loop fastener is complimentary to said second portion of hook and loop fastener for releasably securing said first end to said second end of the associated one of said body members.

6. The exercise system as set forth in claim 1, further comprising:

a pair of cinch straps being coupled to the associated one of said body members fitting around the forearm of the user such that each of said cinch straps is releasably coupled to itself for adjustably securing said body member to the forearm of the user, a first of said cinch straps being positioned proximate said trailing edge of the associated one of said body members, a second of said cinch straps being positioned proximate said leading edge of the associated one of said body members.

7. The exercise system as set forth in claim 1, wherein each of said cinch straps has a cinch buckle coupled to an end of each of said cinch straps, each of said cinch straps being for extending through said respective cinch buckle and cinched back and secured to itself for ensuring securement of the associated one of said body members to the forearm of the user.

8. The exercise system as set forth in claim 1, wherein at least one of said body members has a leg opening, a heel opening, and a toe opening such that the associated one of said body members is adapted for inserting a foot of the user to position the associated one of said body members over an ankle of the user.

9. The exercise system as set forth in claim 8, wherein at least one of said pockets is positioned above the ankle of the user for preventing said pocket from rubbing on the ankle of the user.

10. The exercise system as set forth in claim 1, wherein at least one of said body members has a pair of arm openings, a head opening and a torso opening such that the associated one of said body members is adapted for receiving a torso of a user, the associated one of said body members comprising a back panel and a front panel, said back panel being adapted for covering a back of the user, said front panel being adapted for covering a front of the user.

11. The exercise system as set forth in claim 10, wherein said plurality of said pockets are positioned on said back panel of the associated one of said body members between said pair of arm opening, said weight members in said pockets being adapted for being positioned over shoulder blades of the user for exerting weight resistance to the shoulders of the user.

12. The exercise system as set forth in claim 10, wherein said plurality of said pockets are positioned on said back panel of the associated one of said body members below said arm openings, said weight members in said pockets being adapted for providing weight resistance to a lower back of the user.

13. The exercise system as set forth in claim 10, wherein said plurality of said pockets are positioned on said front panel of the associated one of said body members between said arm.

14. The exercise system as set forth in claim 10, wherein said plurality of said pockets are positioned on said front panel of the associated one of said body members below said arm openings, said weight members in said pockets being adapted for providing weight resistance to the muscles of an abdominal area of the user.

15. The exercise system as set forth in claim 1, wherein said weight members comprise a flexible material such that said weight members are adapted for conforming to a surface area of the user for preventing said weight members from rubbing against the user.

16. The exercise system as set forth in claim 1, wherein each one of said pockets of said plurality of pockets is spaced from all other said pockets of said plurality of pockets.

17. The exercise system as set forth in claim 1, further comprising:

a pair of support straps being coupled to an associated one of said body members fitting on the thigh of the user such that each of said support straps is releasably coupled to itself for adjustably securing the associated one of said body members to the thigh of the user, a first of said support straps being positioned proximate said upper edge of the associated one of said body members, a second of said support straps being positioned proximate said lower edge of the associated one of said body members;

wherein each of said support straps has a buckle coupled to an end of said support strap, each of said support straps being for extending through said respective buckle and cinched back and secured to itself for ensuring securement of the associated one of said body members to the thigh of the user;

wherein at least one of said body members is substantially planar having a first end and a second end, said first end having a first fastener portion for releasably securing to a second fastener of said second end, the associated one of said body members being adapted for securing around an ankle of a user;

wherein said first fastener comprises a first portion of hook and loop fastener, said second fastener comprising a second portion of hook and loop fastener such that said first portion of hook and loop fastener is complimentary to said second portion of hook and loop fastener for releasably securing said first end to said second end of the associated one of said body members;

a pair of cinch straps being coupled to the associated one of said body members fitting around the forearm of the user such that each of said cinch straps is releasably coupled to itself for adjustably securing said body member to the forearm of the user, a first of said cinch straps being positioned proximate said trailing edge of the associated one of said body members, a second of said cinch straps being positioned proximate said leading edge of the associated one of said body members;

wherein each of said cinch straps has a cinch buckle coupled to an end of each of said cinch straps, each of said cinch straps being for extending through said respective cinch buckle and cinched back and secured to itself for ensuring securement of the associated one of said body members to the forearm of the user;

wherein at least one of said body members has a leg opening, a heel opening, and a toe opening such that the associated one of said body members is adapted for inserting a foot of the user to position the associated one of said body members over an ankle of the user;

wherein at least one of said pockets is positioned above the ankle of the user for preventing said pocket from rubbing on the ankle of the user;

wherein at least one of said body members has a pair of arm openings, a head opening and a torso opening such that the associated one of said body members is adapted for receiving a torso of a user, the associated one of said body members comprising a back panel and a front panel, said back panel being adapted for covering a back of the user, said front panel being adapted for covering a front of the user;

wherein said plurality of said pockets are positioned on said back panel of the associated one of said body members between said pair of arm opening, said weight members in said pockets being adapted for being positioned over shoulder blades of the user for exerting weight resistance to the shoulders of the user;

wherein said plurality of said pockets are positioned on said back panel of the associated one of said body members below said arm openings, said weight members in said pockets being adapted for providing weight resistance to a lower back of the user;

wherein said plurality of said pockets are positioned on said front panel of the associated one of said body members between said arm;

wherein said plurality of said pockets are positioned on said front panel of the associated one of said body members below said arm openings, said weight members in said pockets being adapted for providing weight resistance to the muscles of an abdominal area of the user;

wherein said weight members comprise a flexible material such that said weight members are adapted for conforming to a surface area of the user for preventing said weight members from rubbing against the user; and wherein each one of said pockets of said plurality of pockets is spaced from all other said pockets of said plurality of pockets.

18. An exercise system comprising:

a plurality of body members for snuggly fitting around a portion of a body of a user;

a plurality of pockets being coupled to each of said body members, each of said pockets having a flap for securing to a front panel of each said pockets such that said flap is for closing each of said respective pockets;

a plurality of weight members each being selectively insertable into each of said pockets such that said weight members are adapted for changing the weight resistance against muscles of the user when said body member is fitted around a portion of a user;

a first one of said body members inwardly tapering from a trailing edge to a leading edge for fitting a forearm of the user; and a second one of said body members inwardly tapering from an upper edge to a lower edge for fitting a thigh of the user; and a pair of support straps being coupled to an associated one of said body members fitting on the thigh of the user such that each of said support straps is releasably coupled to itself for adjustably securing the associated one of said body members to the thigh of the user, each of said support straps being positioned over at least two of said pockets such that said support straps circumscribe said at least two pockets, a first of said support straps being positioned toward said upper edge of the associated one of said body members, a second of said support straps being positioned toward said lower edge of the associated one of said body members.

19. The exercise system as set forth in claim 18, wherein said plurality of pockets comprises a first pair of pockets being coupled to the first one of said body members, a first one of said first pair of pockets being coupled proximate a leading edge of the first one of said body members, a second one of said first pair of pockets being coupled to the first one of said body members proximate said trailing edge of the first one of said body members such that said second one of said first pair of pockets is adapted for being positioned on an opposite side of the forearm of the user from said first one of said first pair of pockets, said pockets being adapted for spreading the weight from said weight members evenly over the forearm of the user;

wherein said plurality of pockets comprises a second pair of pockets being coupled to the second one of said body members, a first one of said second pair of pockets being coupled proximate to the upper edge of the second one of said body members, a second one of said second pair of pockets being coupled to the second one of said body members proximate to the lower edge of the second one of said body members; and wherein said plurality of pockets comprises a third pair of pockets being coupled to the second one of said body members, a first one and a second one of said third pair of pockets each extending from a location proximate to the upper edge to a location proximate the lower edge of the second one of said body members, the first one of said third pair of pockets being located on an opposite side of said second pair of pockets from the second one of said third pair of pockets.

* * * * *